US006169524B1

(12) United States Patent
Wu et al.

(10) Patent No.: US 6,169,524 B1
(45) Date of Patent: Jan. 2, 2001

(54) MULTI-PATTERN ANTENNA HAVING FREQUENCY SELECTIVE OR POLARIZATION SENSITIVE ZONES

(75) Inventors: Te-Kao Wu, Rancho Palos Verdes; Charles W. Chandler, San Gabriel, both of CA (US)

(73) Assignee: TRW Inc., Redondo Beach, CA (US)

( * ) Notice: Under 35 U.S.C. 154(b), the term of this patent shall be extended for 0 days.

(21) Appl. No.: 09/232,899

(22) Filed: Jan. 15, 1999

(51) Int. Cl.[7] ..... H01Q 15/02; H01Q 15/24
(52) U.S. Cl. ..... 343/910; 343/840
(58) Field of Search ..... 343/909, 910, 343/779, 781 P, 781 R, 840, 756, 753; H01Q 15/02, 15/24

(56) References Cited

U.S. PATENT DOCUMENTS 3,189,907 * 6/1965 Buskirk ..... 343/910
4,757,323 * 7/1988 Duret et al. ..... 343/756
4,831,384 * 5/1989 Sefton, Jr. ..... 343/909
4,851,858 * 7/1989 Frisch ..... 343/909
4,905,014 * 2/1990 Gonzalez et al. ..... 343/909
5,136,294 * 8/1992 Iwata ..... 343/781 P
5,365,245 * 11/1994 Ho ..... 343/840

OTHER PUBLICATIONS

Lee, et al., "Compound Reflector Antennas," published in the IEEE Proceedings on Antennas and Propagation, Apr. 1992, pp. 135–138.

* cited by examiner

*Primary Examiner*—Don Wong
*Assistant Examiner*—Hoang Nguyen
(74) *Attorney, Agent, or Firm*—Michael S. Yatsko; Connie Thousand

(57) ABSTRACT

A multi-pattern antenna for providing a plurality of antenna patterns at different frequencies or polarizations from a single reflector body eliminates the need for multiple reflector antennas on a single spacecraft. The reflector antenna comprises a reflector body and an illumination source. The illumination source illuminates the reflector with a plurality of RF signals each of a preselected frequency or polarization. The reflector comprises a plurality of zones with each zone reflecting preselected RF signals. A plurality of antenna patterns are generated from the reflected RF signals. Each zone is sized to a preselected shape such that the antenna patterns have a desired shape or beamwidth characteristic.

15 Claims, 15 Drawing Sheets

MULTI-PATTERN ANTENNA HAVING FREQUENCY SELECTIVE OR POLARIZATION SENSITIVE ZONES

BACKGROUND OF THE INVENTION

1. Field of the Invention

The present invention relates to the field of reflector antennas, and more particularly, to a reflector antenna which includes frequency selective or polarization sensitive zones to provide a plurality of antenna patterns having different polarizations or frequencies from a single reflector.

2. Description of the Prior Art

Reflector antennas are frequently used on spacecraft to provide multiple uplink and downlink communication links between the spacecraft and the ground. The downlinks operate at one frequency, typically around 20 GHz, and the uplinks operate at a second higher frequency, typically around 30 or 44 GHz. It is typically desirable for a single spacecraft to have multiple uplink and downlink antennas where each antenna provides a separate antenna pattern covering a predetermined coverage zone on the earth. It is also typically desirable to provide both an uplink and downlink antenna pattern having the same beamwidth so that users can both receive and transmit to the same spacecraft. For example, a single spacecraft may have one uplink antenna which provides a 3°×6° antenna beam at 30 GHz for uplink communications from the continental United States (CONUS), and, one downlink antenna at a frequency of 20 GHz which provides a 30°×6° beam for downlink communications to CONUS. The method typically used to provide multiple uplink and downlink antenna patterns from a single spacecraft is to provide separate reflectors for each uplink and downlink antenna. This requires a large amount of space on a spacecraft, is expensive and extracts a weight penalty.

One method attempted to save weight is to couple one uplink and one downlink antenna together in a single reflector body. To do so, an illumination source is configured to illuminate the reflector body with two RF signals, one having a frequency of 20 GHz and the other having a frequency of 30 GHz. The reflector is typically fabricated of a composite or honeycombed material coated with a reflective material, typically aluminum, which is reflective to RF signals of all frequencies. The disadvantage with this system is that it is difficult to provide antenna patterns having predetermined beamwidths at different frequencies from the typical reflector. The beamwidth of an antenna beam is inversely proportional to the size of the reflector and the frequency of illumination. From the same sized reflector, the uplink antenna pattern at 30 GHz would have a smaller beamwidth than the downlink antenna pattern at 20 GHz thereby covering a smaller coverage zone than the downlink antenna pattern. To address this problem, conventional reflector antennas have used specially designed feed horns configured to under illuminate the reflector at 30 GHz, the higher frequency, thereby generating an antenna pattern at 30 GHz having a wider beamwidth. This is inefficient and often difficult to do since feed horns are extremely sensitive to tolerance and bandwidth limitations.

A need exists to have a single reflector which provides a plurality of antenna patterns each having a predetermined beamwidth allowing a single spacecraft to carry the weight and expense of only one reflector while having the ability to provide multiple uplink and downlink antenna patterns.

SUMMARY OF THE INVENTION

The aforementioned need in the prior art is satisfied by this invention, which provides a reflector antenna having frequency selective or polarization sensitive zones to provide a plurality of antenna patterns from a single reflector body. A reflector antenna, in accord with the invention, comprises a single concave reflector body having a plurality of zones with each zone configured as a frequency selective or polarization sensitive zone. The zones can be partially, completely or not overlapping. An illumination source is configured to illuminate the reflector body with a plurality of RF signals with each zone reflecting one or more of the RF signals. The reflector body generates a plurality of antenna patterns from the reflected RF signals with the shape & beamwidth of the antenna patterns being determined by the shape and dimensions of each zone. The shape and dimensions of each zone is thus preselected to provide an antenna pattern having a desired shape and beamwidth.

For the preferred embodiment of the invention, the reflector body has two concentric zones comprised of an inner zone and an outer zone encompassing the inner zone. The two zones are illuminated with the RF signals having frequencies of approximately 20 GHz and 30 GHz. The inner zone is comprised of a material which is reflective to RF signals of all frequencies, and, the outer zone is comprised of a material which reflects RF signals of a 20 GHz frequency and passes RF signals having a frequency of 30 GHz. The 30 GHz signal is reflected only by the inner zone and is not reflected by the second zone. Antenna patterns are generated at 20 and 30 GHz from the 20 and 30 GHz reflected signals respectively with the size and shape of only the inner zone determining the shape and beamwidth of the 30 GHz antenna pattern and the shape and beamwidth of both zones determining the shape and beamwidth of the 20 GHz antenna pattern. The dimensions of the inner and first zone are preselected to generate 20 and 30 GHz antenna patterns having approximately equal shapes and beamwidth.

BRIEF DESCRIPTION OF THE DRAWINGS

Reference is now made to the detailed description of the preferred embodiments illustrated in the accompanying drawings, in which.

DETAILED DESCRIPTION OF THE INVENTION

Figure 1A:
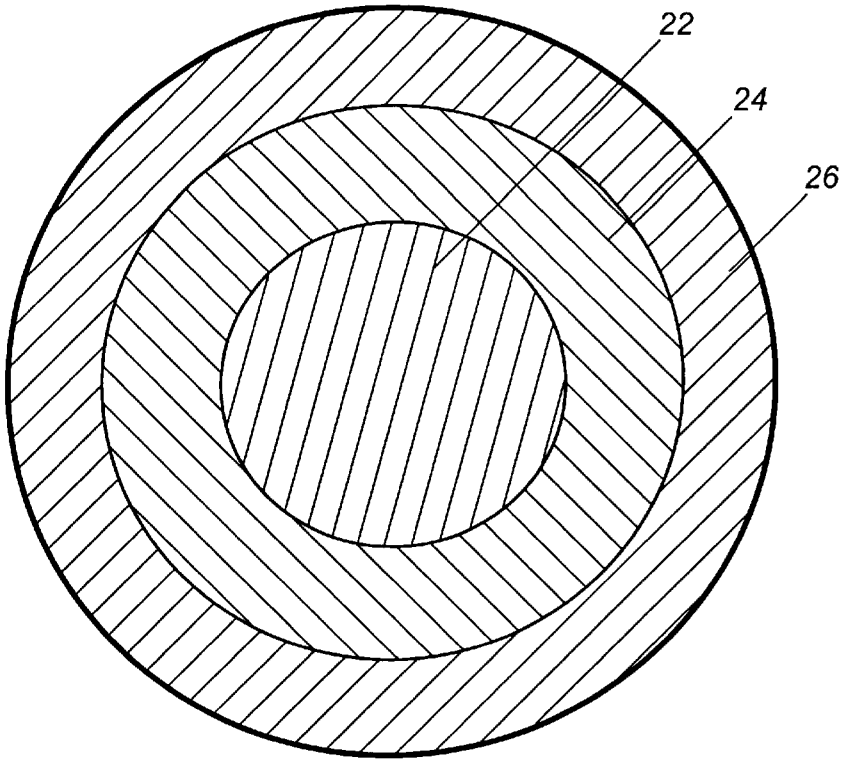
FIG. 1*a* is a top plane view of a reflector body in accordance with one embodiment of the invention.
Figure 1B:
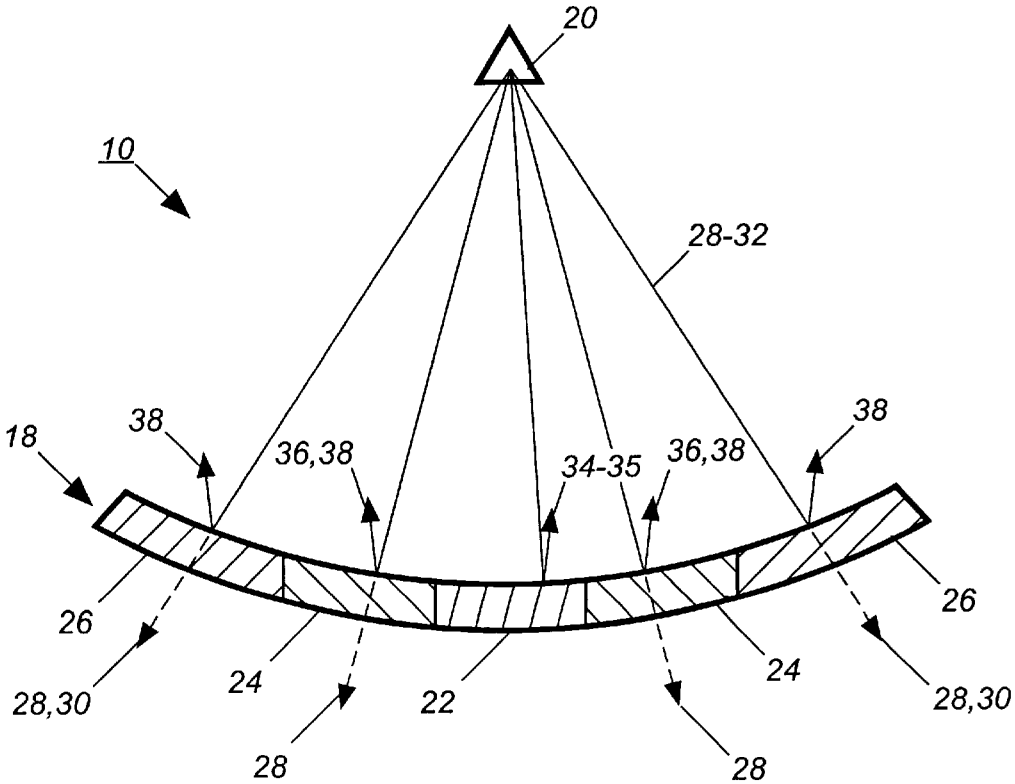
FIG. 1*b* is a side plane view of a reflector antenna having the reflector body shown in FIG. 1*a;*
Figure 1C:
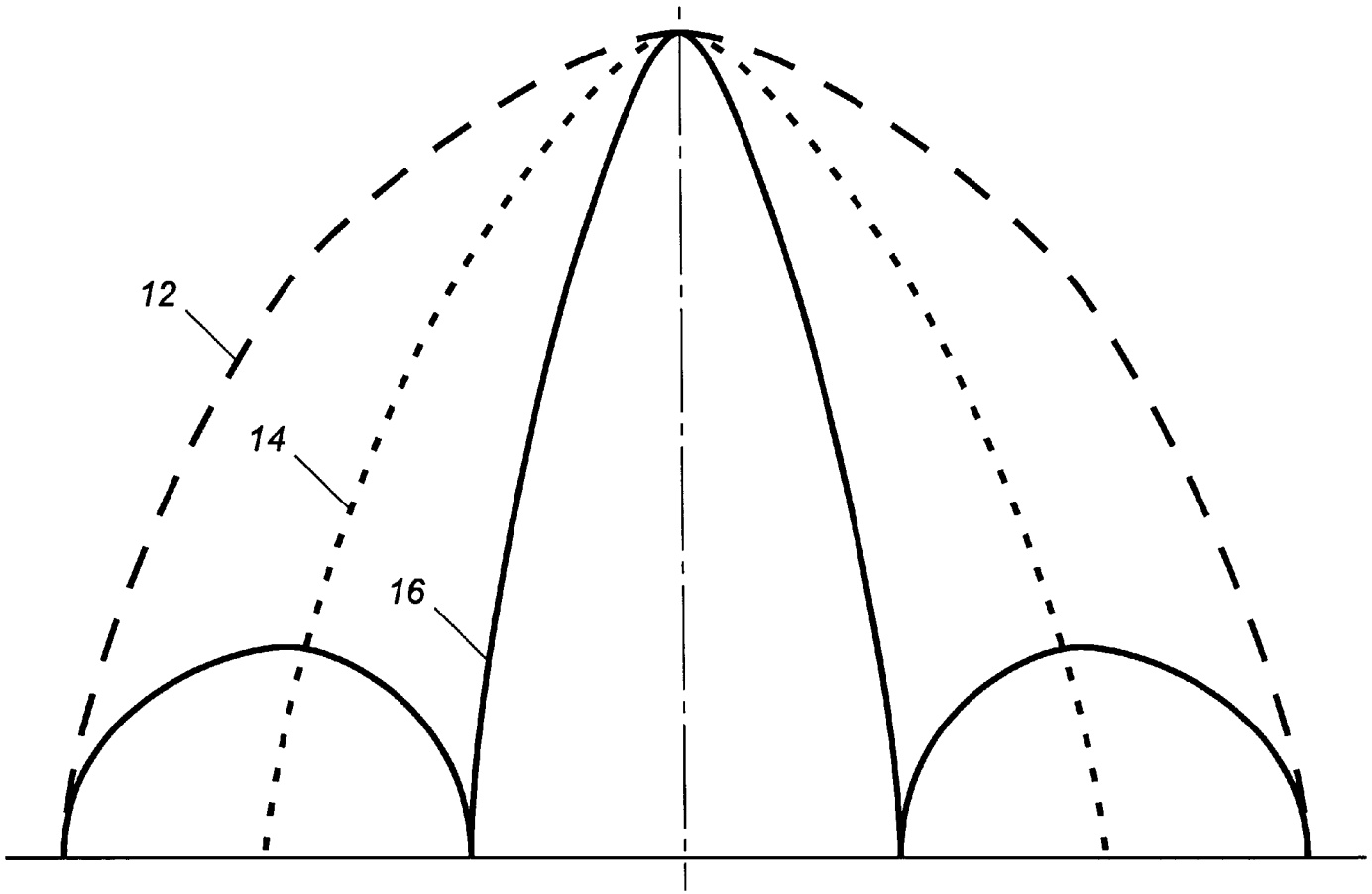
FIG. 1*c* shows antenna patterns generated by the reflector antenna shown in FIG. 1*b;*

Referring to FIGS. 1*a*–1*c,* a reflector antenna 10 for providing multiple antenna patterns 12–16 is illustrated. The reflector antenna 10 can be configured as a prime focus feed reflector, an offset reflector, a cassegrain reflector or the like. The reflector antenna 10 includes a reflector body 18 and an illumination source 20. The reflector body 18 is comprised of a plurality of zones 22–26 with each zone 22–26 configured to be a frequency selective or polarization sensitive zone. The illumination source 20 is configured to illuminate the reflector body 18 with a plurality of RF signals depicted by the lines marked 28–32 with each RF signal 28–32 being of a preselected frequency or polarization. Each zone 22–26 is configured to selectively reflect, pass or absorb selected RF signals 28–32 having preselected frequencies or polarizations. Antenna patterns 12–16 are generated from each reflected RF signal 34–38 with the characteristics of each antenna pattern 12–16, including the shape and beamwidth, being determined by the shape and dimensions of the zones 22–28. The size and shape of each zone 22–28 is preselected so that antenna patterns 12–16 are generated having desired shapes and beamwidths. By configuring a single reflector body 18 to comprise one or more frequency selective or polarization sensitive zones 22–26, a plurality of antenna patterns 12–16, each being of a preselected shape and beamwidth, can be generated from a single reflector antenna 10.

Figure 2A:
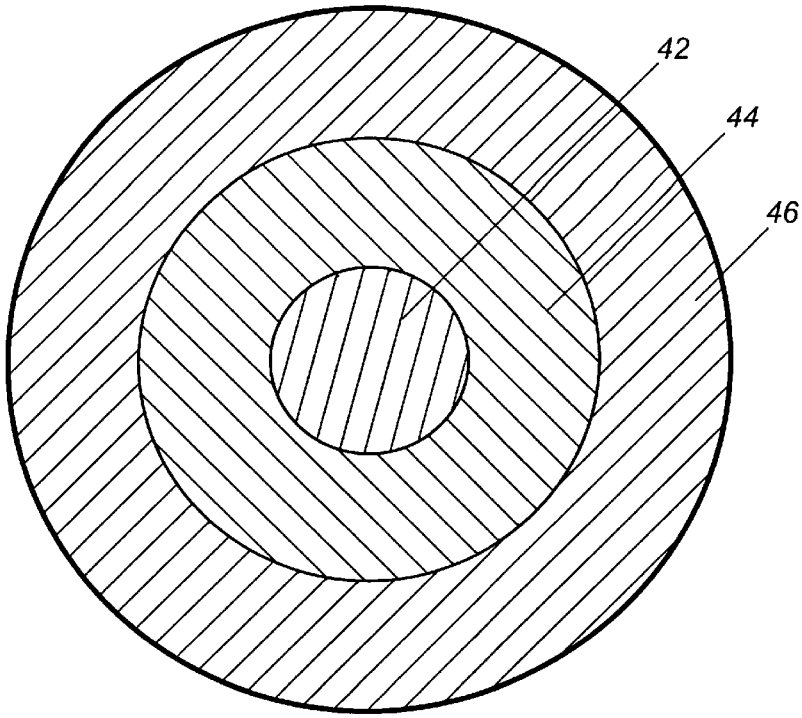
FIG. 2*a* is a top plane view of a reflector body in accordance with a second embodiment of the invention.
Figure 2B:
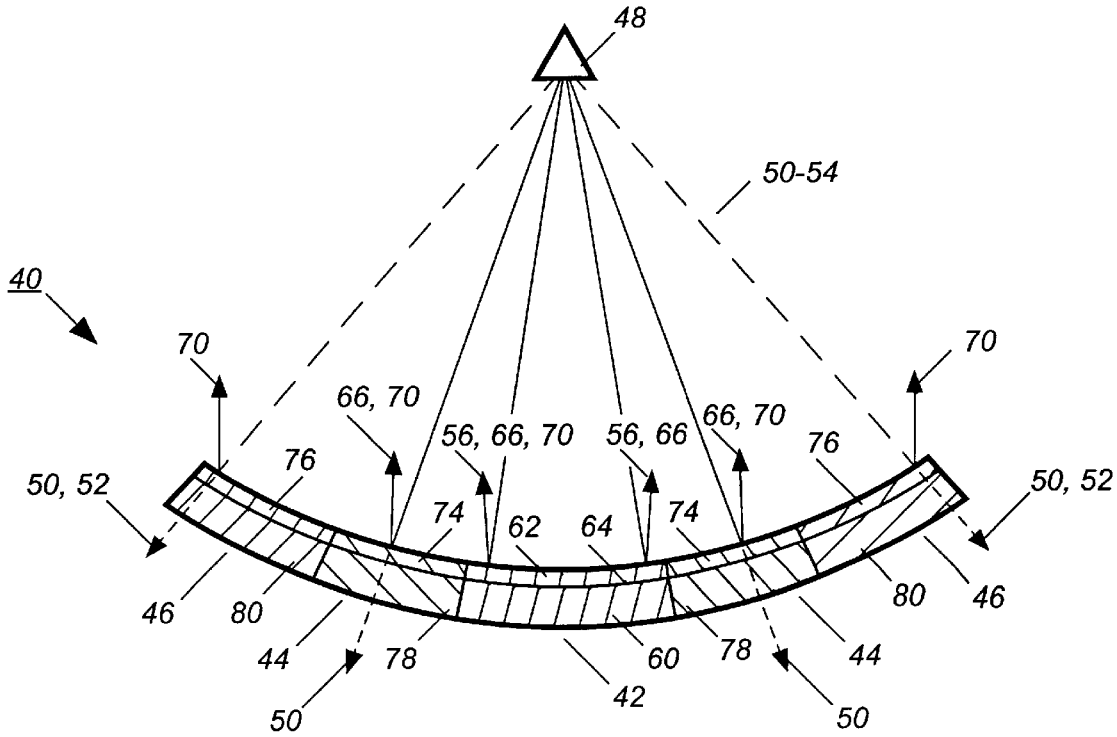
FIG. 2*b* is a side plane view of a reflector antenna having the reflector body shown in FIG. 2*a;*
Figure 2C:
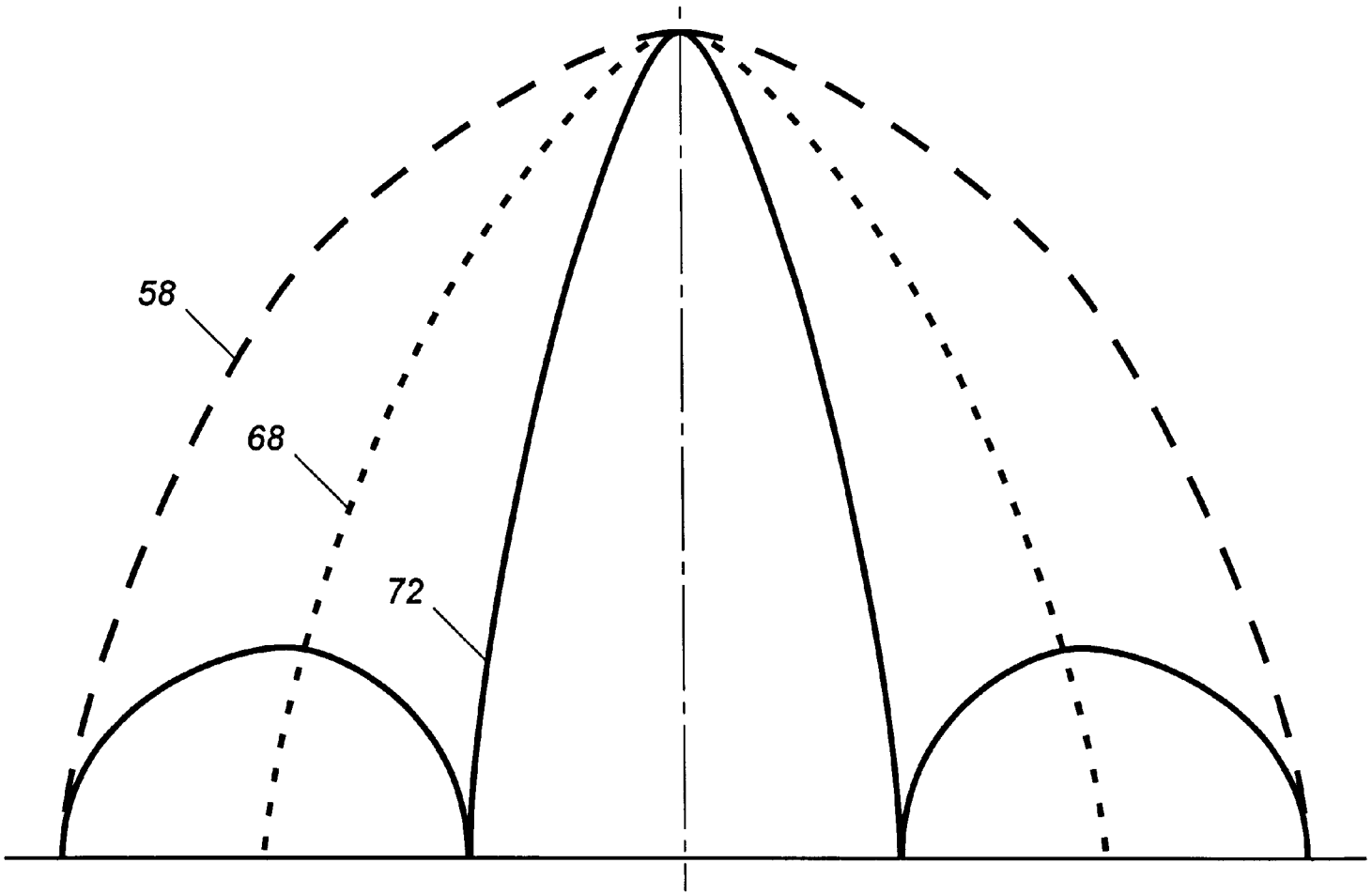
FIG. 2*c* shows antenna patterns generated by the reflector antenna shown in FIG. 2*b;*
Figure 3A:
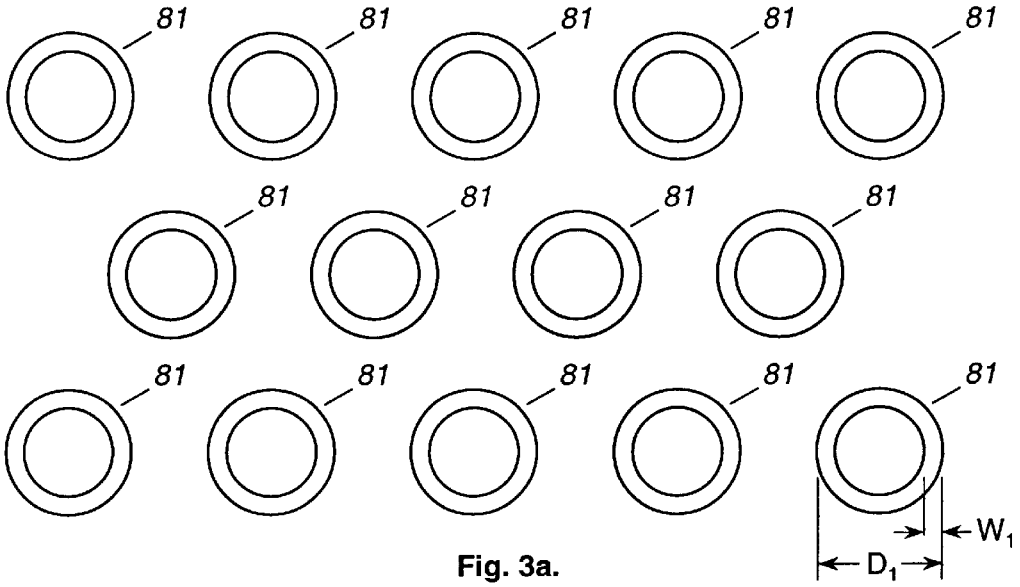
FIG. 3*a* is a top plane view of circular loop frequency selective elements in accordance with a third embodiment of the invention.
Figure 3B:
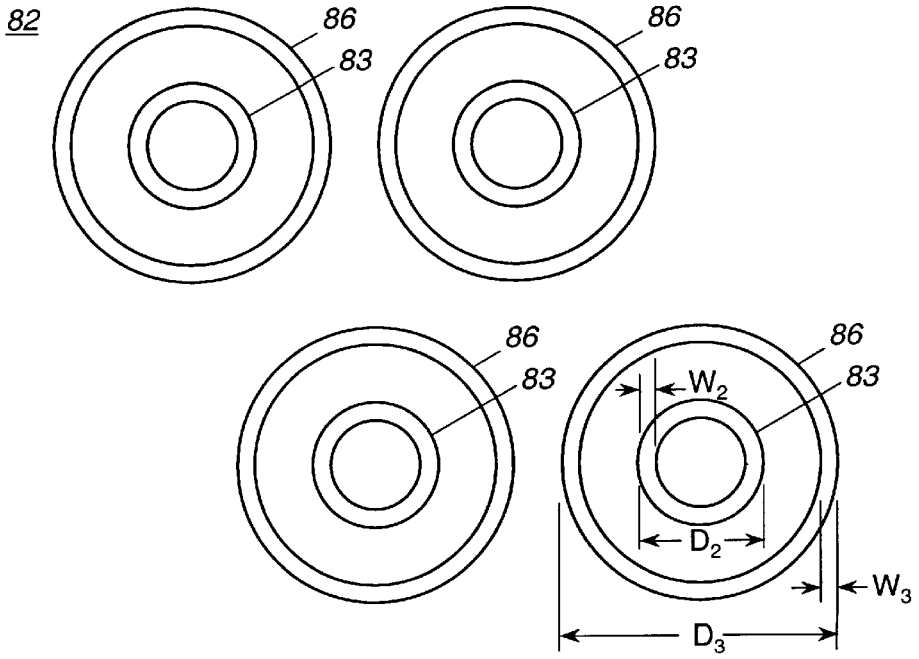
FIGS. 3*b* and 3*c* are top plane views of nested circular loop frequency selective elements in accordance with a fourth embodiment of the invention.
Figure 3C:
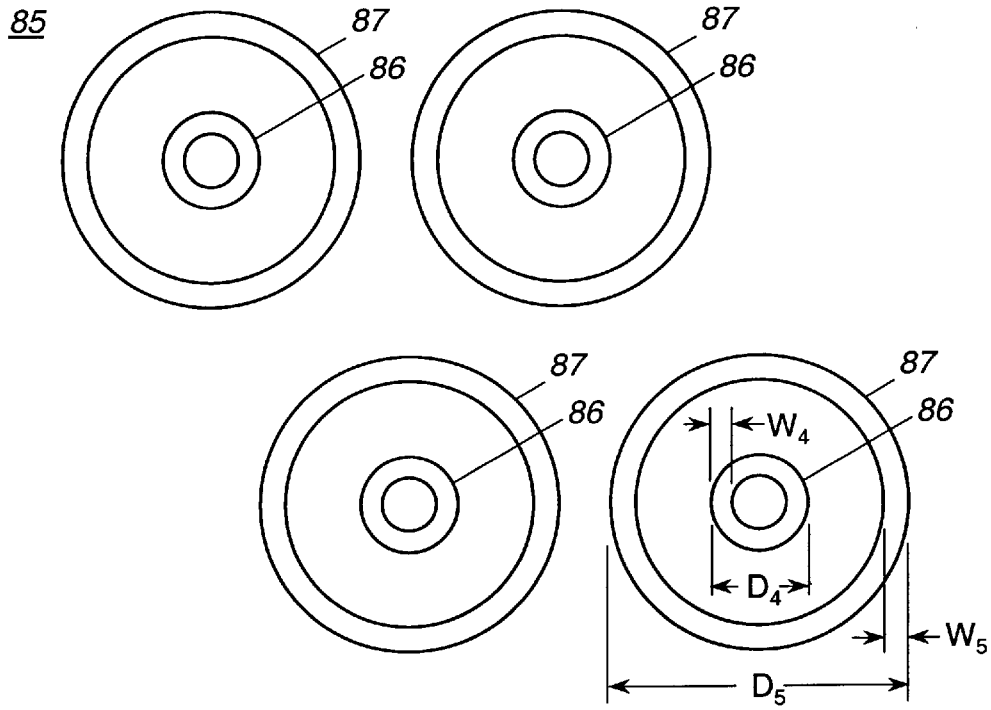

For one embodiment of the invention shown in FIGS. 2*a*–2*c,* the reflector body 40 is comprised of three concentric zones 42–46. The first zone 42 is configured to reflect RF signals having frequencies of f1–f3; the second zone 44 is configured to reflect RF signals having frequencies f2 and f3 and pass RF signals having a frequency of f1. The third zone 46 is configured to reflect RF signals having frequencies of f3 and pass RF signals having frequencies of f1 and f2. The illumination source 48 is configured to generate three RF signals depicted by the lines marked 50–54 where each RF signal 50–54 is of a different frequency f1–f3 respectively.

The first RF signal 50 is incident on the reflector body 40 with the portion of the first RF signal 50 which is incident upon the first zone 42 being reflected by the first zone 42. However, the portion of the first RF signal 50 which is incident on the second 44 and third 46 zones is not reflected and pass through the second 44 and third 46 zones. Thus, only the first zone 42 reflects the first RF signal 50 to provide a first reflected signal 56 which will form a first antenna pattern 58 having characteristics including shape and beamwidth which are substantially determined by the shape and dimensions of only the first zone 42. The shape and dimensions of the first zone 42 is thus preselected to provide a first antenna pattern 58 having predetermined pattern characteristics such as shape and beamwidth.

The first zone 42 is preferably formed of a light weight core 60 fabricated from a material such as Graphite, Kevlar™, Nomex™, aluminum honeycomb, or the like which are all commercially available materials with Kevlar™ being fabricated by Hexcel Corporation located in Huntington Beach, Calif. and Nomex™ being fabricated by Hexcel Corporation located in Huntington Beach, Calif. A highly reflective coating 62 such as aluminum is typically applied to the top surface 64 of the light weight core 60 preferably by a vapor deposition or sputtering process to provide a surface which is highly reflective to RF signals 50–54 of a plurality of frequencies. A more detailed description of processes such as vapor deposition or sputtering used to apply materials can be found in Microelectronic Processing and Device Design, by Roy A Colclaser, 1980.

The second RF signal 52 is incident on the reflector body 40 with the portion of the second RF signal 52 which is incident upon the first 42 and second 44 zones being reflected 66 by the first 42 and second 44 zones. However, the portion of the second RF signal 52 which is incident on the third 46 zone is not reflected and passes through the third 46 zone. Thus, only the first 42 and second 44 zones reflect the second RF signal 52 to provide a second reflected signal 66 which will form a second antenna pattern 68 having characteristics which are substantially determined by the shape and dimensions of both the first 42 and second 44 zones combined.

The third RF signal 54 is incident on the reflector body 40 and is reflected 70 by the all three zones 50–54. A third antenna pattern 72 is generated from the third reflected RF signal 70 with characteristics associated with the dimensions of all three zones 42–46 combined.

Each frequency selective zone 44 & 46 is typically comprised of a patterned metallic top layer 74 or 76 over a dielectric core 78 or 80 respectively. The dielectric cores 78 and 80 are fabricated of materials such as Kevlar™, Nomex™, Ceramic Foam, Rohacell foam™ or the like which are commercially available materials known in the art to pass RF signals with Rohacell foam™ being fabricated by Richmond Corporation located in Norwalk, Calif. For simplicity in manufacturing, all three cores 60, 78 and 80 are typically fabricated of the same materials. To produce the patterned metallic top layers 74 and 76, a metallic top layer is first applied to the dielectric cores 78 and 80 using a vapor depositing or sputtering process and portions of the metallic top layer are removed by an etching technique thereby forming the patterned metallic top layers 78 and 80. A more detailed discussion of vapor depositing, sputtering and etching processes can be found in the reference cited above. Alternatively, the patterned top layers 74 and 76 can be formed on separate sheets of material and then bonded to the cores 78 and 80 respectively. The patterned layers 74 and 76 typically include crosses, squares, circles, "Y's" or the like with the exact design and dimensions of the patterned top layers 74 and 76 being determined by experimental data coupled with design equations and computer analysis tools such as those found in the book Frequency Selective Surface and Grid Array, by T. K. Wu, published by John Wiley and Sons, Inc. The design and dimensions of the first patterned top layer 74 covering the second core 78 is selected to reflect RF signals having frequencies f2 and f3 and pass RF signals having a frequency of f1, whereas, the patterned top layer 76 covering the third core 80 is selected to reflect RF signals having a frequency of f3 and pass RF signals having frequencies f1 & f2.

For example, referring to FIGS. 2*a,* 2*b,* and 3*a,* 3*b* and 3*c,* the first patterned metallic top layer 74 could consist of a plurality of singular circular loops 81 each of which having a diameter of D1 and a width of W1. Alternatively, the first patterned metallic top layer 74 could consist of a plurality of nested circular loops 82 where each nested circular loop 82 is comprised of an inner loop 83 and an outer loop 84. Each inner loop 83 has a diameter D2 and a width W2, and, each outer loop 84 has a diameter D3 and width W3 where D2<D3 and W2<W3. Both the singular circular loops 81 and the nested circular loops 82 will pass RF signals having a frequency of 44 GHz and reflect RF signals having frequencies of 29 and 30 GHz. Nested circular loops 82 are preferred for embodiments which pass and reflect RF signals which are closely spaced in frequency.

The second metallic top layer 76 could also consist of a plurality of nested circular loops 85 where each nested circular loop 85 is comprised of an inner loop 86 and an outer loop 87. Each inner loop 86 has a diameter D4 and a width W4, and, each outer loop 87 has a diameter D5 and width W5 where D4<D5 and W4<W5. These nested circular loops 85 will pass RF signals having frequencies of 30 and 44 GHz but will reflect RF signals having a frequency of 20 GHz.

Alternatively, frequency selective zones 44 & 46 can be fabricated from RF absorbing materials which absorb RF signals of preselected frequencies and reflect RF signals of other preselected frequencies. One such material is a carbon loaded urethane material manufactured by The Lockheed-Martin Corporation located in Sunnyvale Calif.

For the embodiment of the invention shown in FIGS. 4*a*–4*d,* the reflector antenna 86 is comprised of an offset reflector body 88 having four zones 90–96 with each zone 90–96 configured to pass or reflect RF signals, depicted by the lines marked 98–104 of preselected frequencies f1–f4. The illumination source 106 is comprised of four feed horns 108–114 with each feed horn 108–114 generating one of the RF signals 98–104 respectively. The first zone 90 is configured to be reflective to RF signals of all frequencies such that all four RF signals 98–104 are reflected 116–122 by the first zone 90. The second zone 92 is configured to be reflective to RF signals 100–104 having frequencies of f2–f4 and pass RF signals 98 having a frequency of f1 such that the second 100 through fourth 104 RF signals are reflected 118–122 by the second zone 92 and the first RF signal 98 passes through the second zone 92. The third zone 94 is configured to be reflective to RF signals 102 and 104 having frequencies of f3 & f4 and pass RF signals 98 and 100 having frequencies of f1 & f2 such that the third 102 and fourth 104 RF signals are reflected 120 and 122 by the third zone 94 and the first 98 and second 100 RF signals pass through the third zone 94. The fourth zone 96 is configured to reflect an RF signal 104 having a frequency of f4 and pass RF signals 98–102 having frequencies of f1–f3 such that the fourth 104 RF signal is reflected 122 by all from zones 90–96.

Figure 4A:
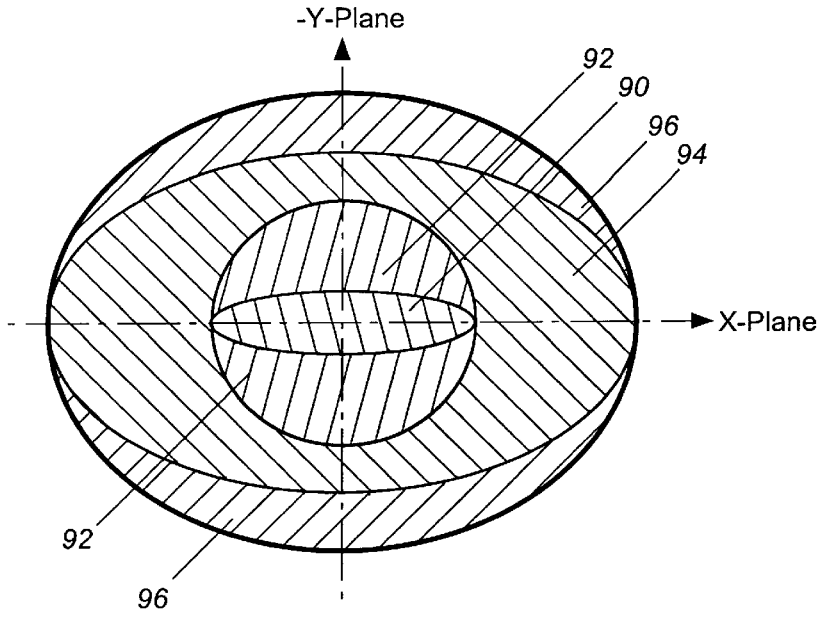
FIG. 4*a* is a top plane view of a reflector body in accordance with a fifth embodiment of the invention.
Figure 4B:
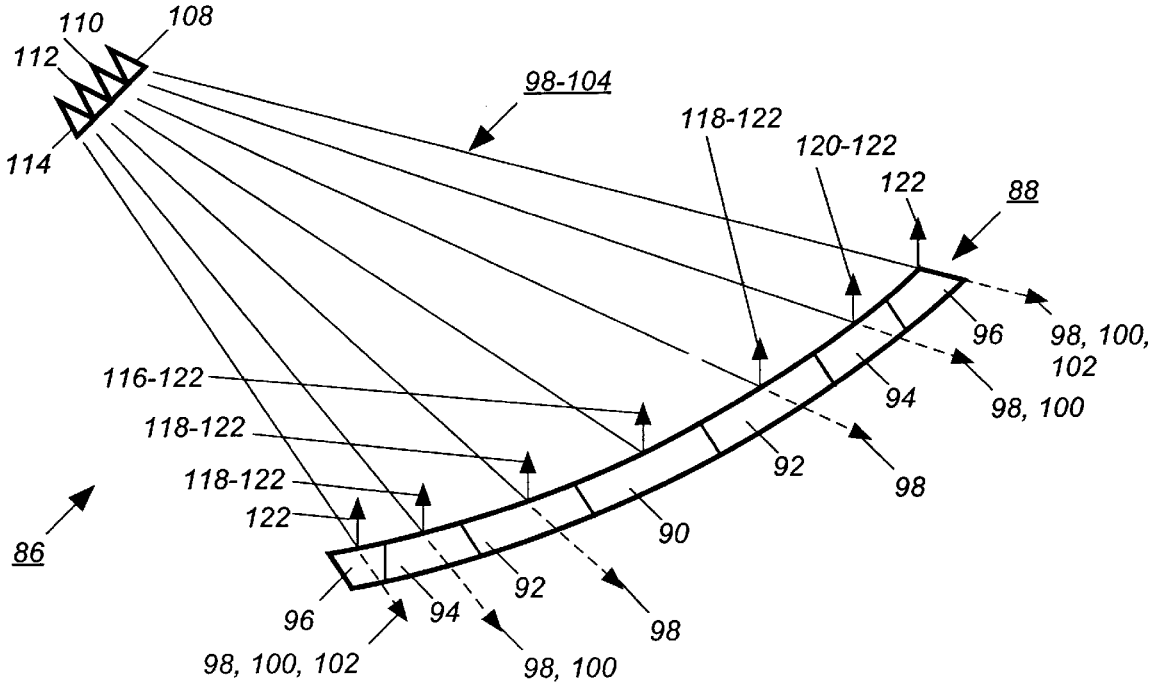
FIG. 4*b* is a side plane view of a reflector antenna having the reflector body shown in FIG. 4*a;*
Figure 4C:
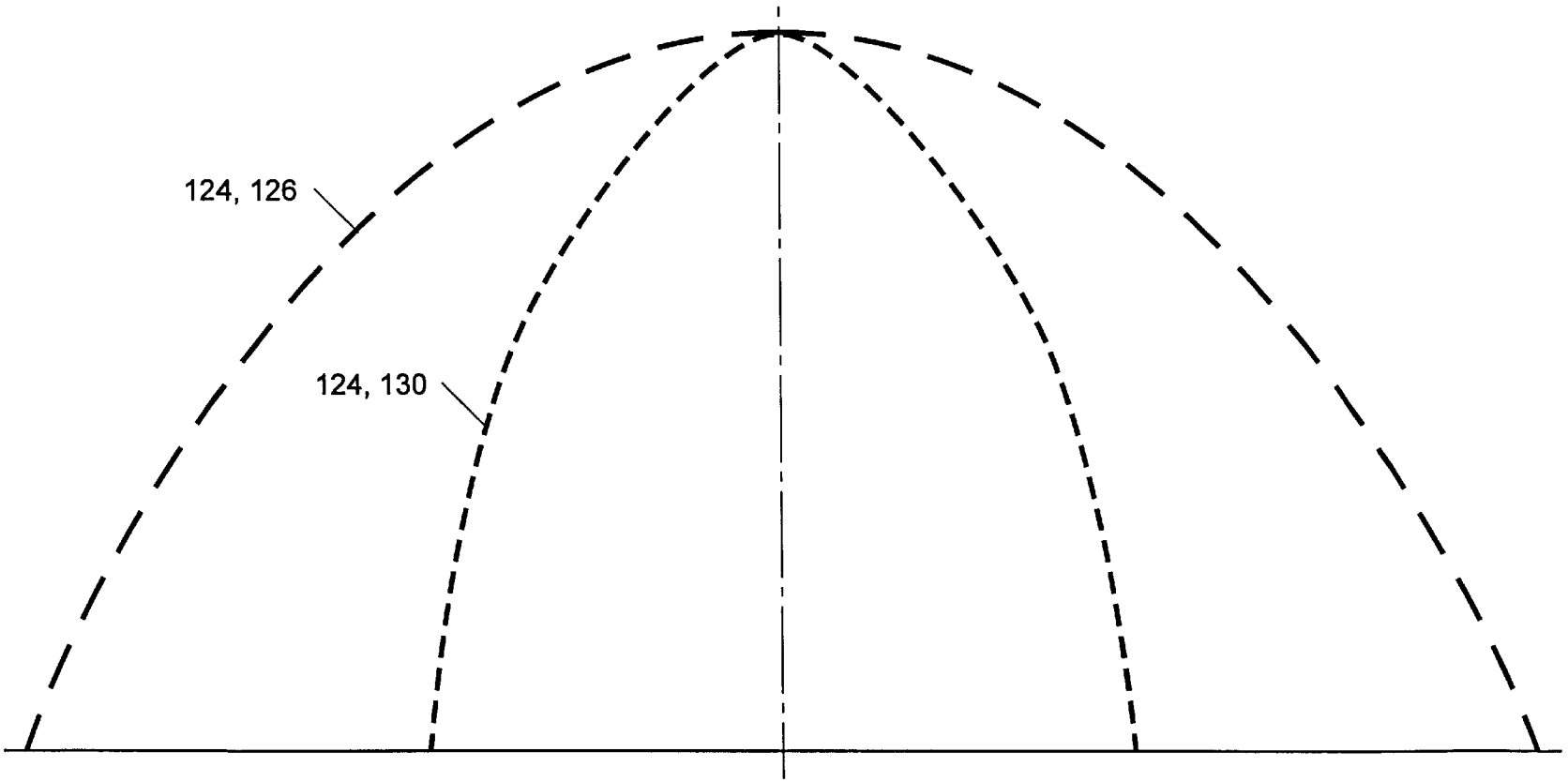
FIGS. 4*c* and 4*d* show the x and y axis principle plane antenna patterns respectively generated by the reflector antenna shown in FIG. 4*b.*
Figure 4D:
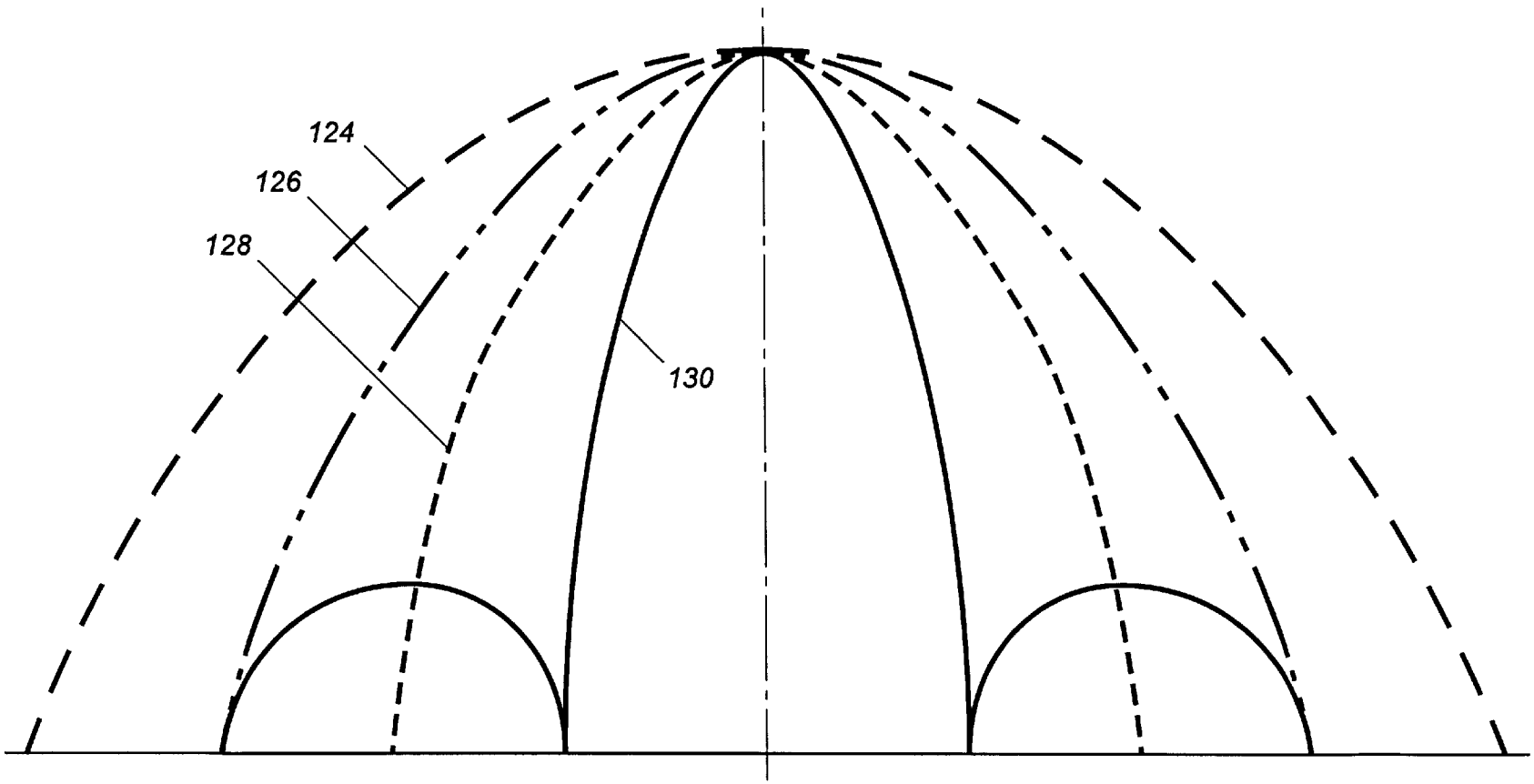

The dimensions of each zone 90–96 determines the characteristics of the antenna patterns 124–130 generated therefrom. FIGS. 4*c* and 4*d* shows the principal plane cuts of the antenna patterns generated by the antenna 86 in the x and y planes (FIG. 4*a*) respectively. The first 90 and third 94 zones are configured in elliptical shapes, and, the second 92 and fourth 96 zones are configured in circular shapes. Thus, the antenna patterns 130 and 126 generated from the first 116 and third 120 reflected signals will have elliptical pattern shapes and the antenna patterns 128 and 124 generated from the second 118 and fourth 122 reflected signals will have circular pattern shapes. This embodiment of the invention generates four antenna patterns 124–130 from a single reflector antenna 86 with each antenna pattern having a predetermined shape and being of a different frequency f1–f4 respectively.

Figure 5A:
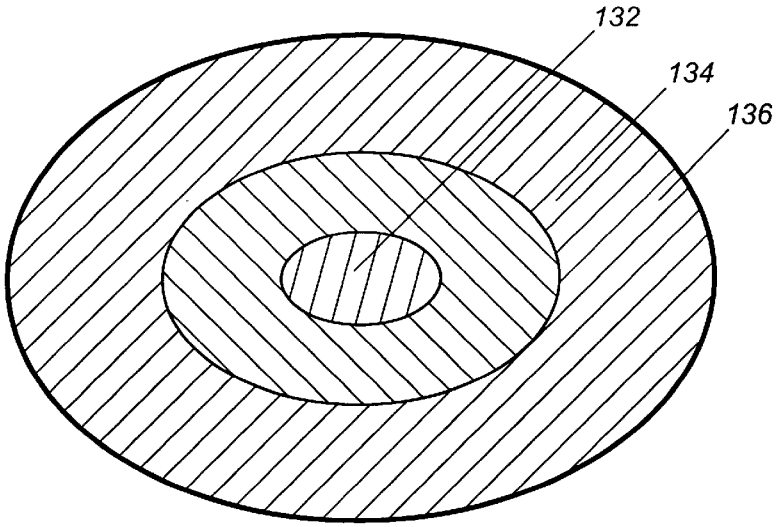
FIG. 5*a* is a top plane view of a reflector body in accordance with a sixth embodiment of the invention.
Figure 5B:
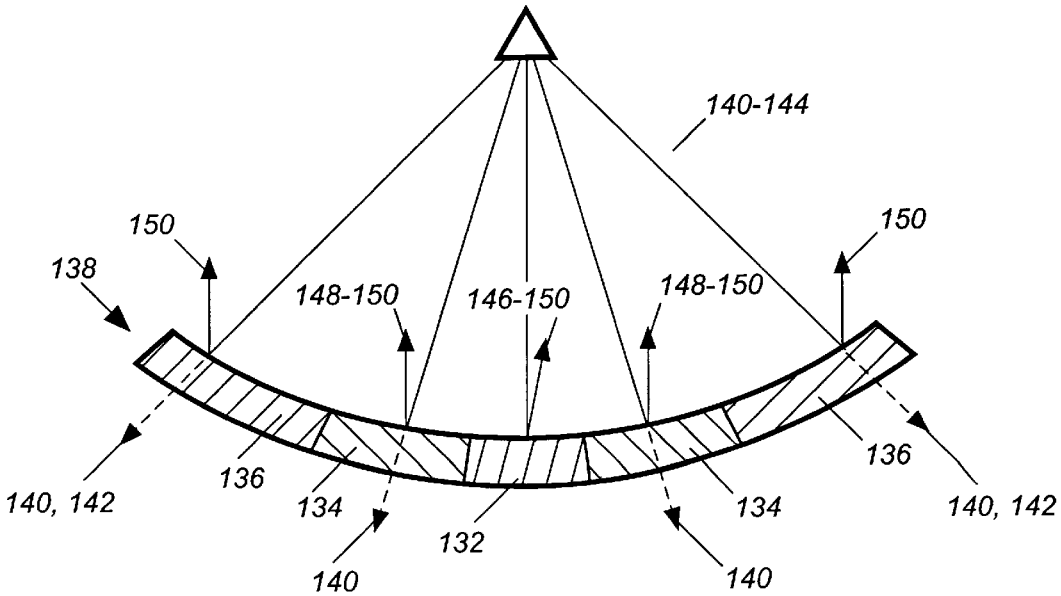
FIG. 5*b* is a side plane view of a reflector antenna having the reflector body shown in FIG. 5*a;*
Figure 5C:
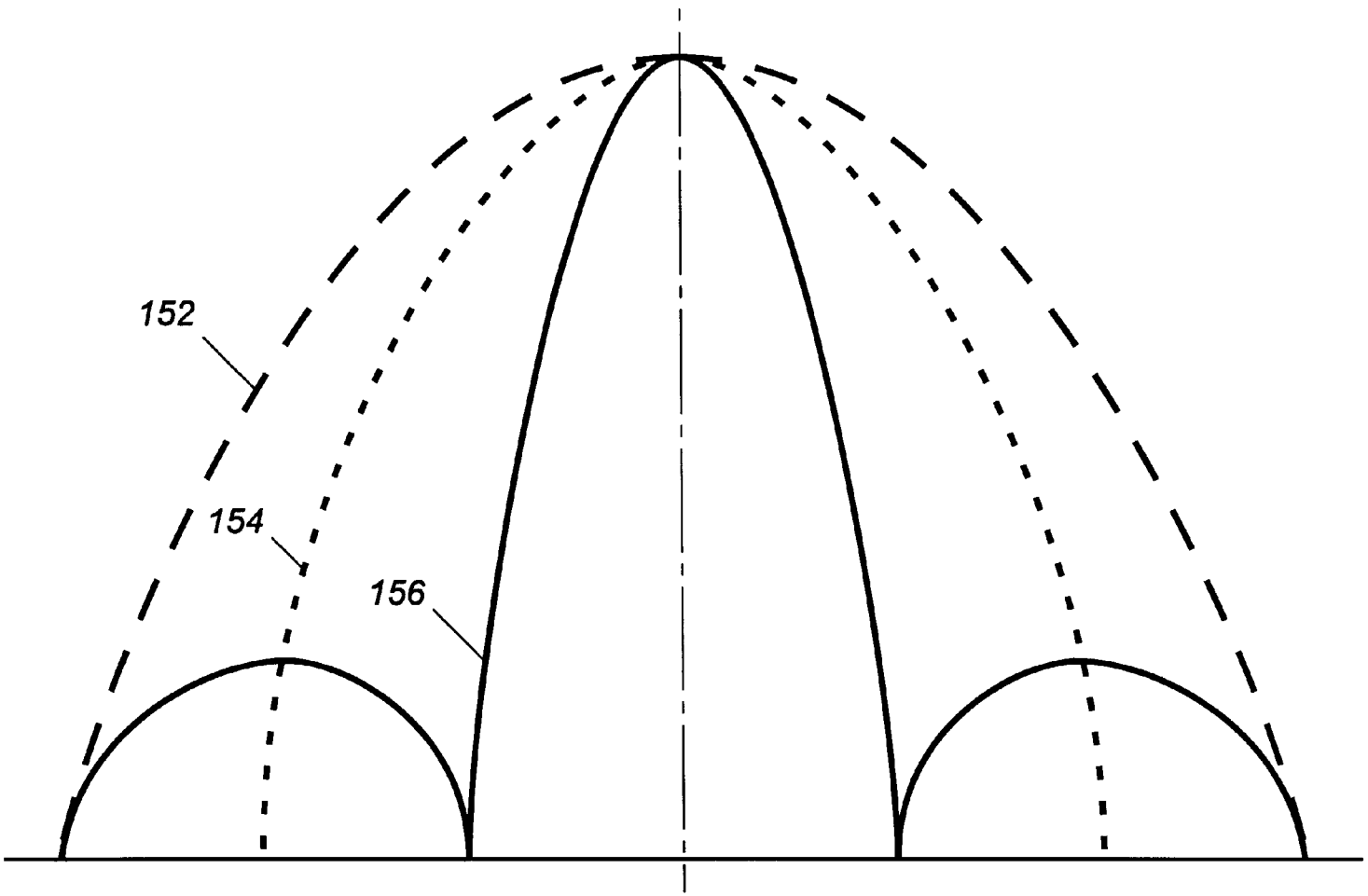
FIG. 5*c* shows antenna patterns generated by the reflector antenna shown in FIG. 5*b;*

Referring to FIGS. 5*a*–5*c,* for a second embodiment of the invention, the first zone 132 reflects all RF signals, the second zone 134 is a polarization sensitive zone; and, the third zone 136 is both a frequency selective and polarization sensitive zone.

Polarization sensitive zones will pass RF signals having one sense of polarization and reflect orthogonally polarized signals. For example, a polarization sensitive zone will either pass horizontally polarized RF signals and reflect vertically polarized RF signals or pass vertically polarized RF signals and reflect horizontally polarized RF signals. Like the frequency selective zones described in the embodiments above, polarization sensitive zone are typically comprised of a patterned metallic top layer over a dielectric core. For horizontally or vertically polarized RF signals, the patterned top layer typically includes metallic parallel lines oriented such that an RF signal having one sense of polarization is passed through and an orthogonally polarized RF signal is reflected. Using polarization sensitive zones enables two oppositely polarized RF signals operating at the same frequency to be coupled in a single reflector with each reflected RF signal providing a separate antenna pattern having a desired shape and beamwidth.

For example, the first zone 132 is configured to reflect all RF signals. The second zone 134 is configured as a polarization sensitive zone 134 designed to reflect all vertically polarized RF signals regardless of the frequency. The third zone 136 is configured to be both a frequency selective and polarization sensitive zone 136 which is designed to reflect only vertically polarized RF signals having a frequency of f2.

The reflector 138 is illuminated by three RF signals, depicted by the lines marked 140–144. The first RF signal 140 is at a first frequency f1 and is horizontally polarized. This RF signal 140 will be reflected 146 by the first zone 132 but will pass through the second 134 and third 136 zones. A horizontally polarized antenna pattern 152, having a frequency of f1, and having characteristics determined by the dimensions of the first zone 132 will be generated from the first reflected signal 146.

The second RF signal 142 is also at a frequency of f1 but is vertically polarized. This second RF signal 142 will be reflected 148 by both the first 132 and second 134 zones but will pass through the third zone 136. A vertically polarized antenna pattern 154, having a frequency of f1, and having characteristics determined by the characteristics of both the first 132 and second 134 zones will be generated from the second reflected signal 148.

The third RF signal 144 is also vertically polarized but is at a different frequency f2. The third zone 136 is both a frequency selective and a polarization sensitive zone 136 configured to pass all horizontally polarized RF signals regardless of frequency but reflect vertically polarized RF signals of a frequency f2. The third RF signal 144 will be reflected 150 by all three zones 132–136. A vertically polarized antenna pattern 156, having a frequency of f2, and having characteristics determined by the characteristics of the entire reflector 138 will be generated from the third reflected signal 150.

Figure 6A:
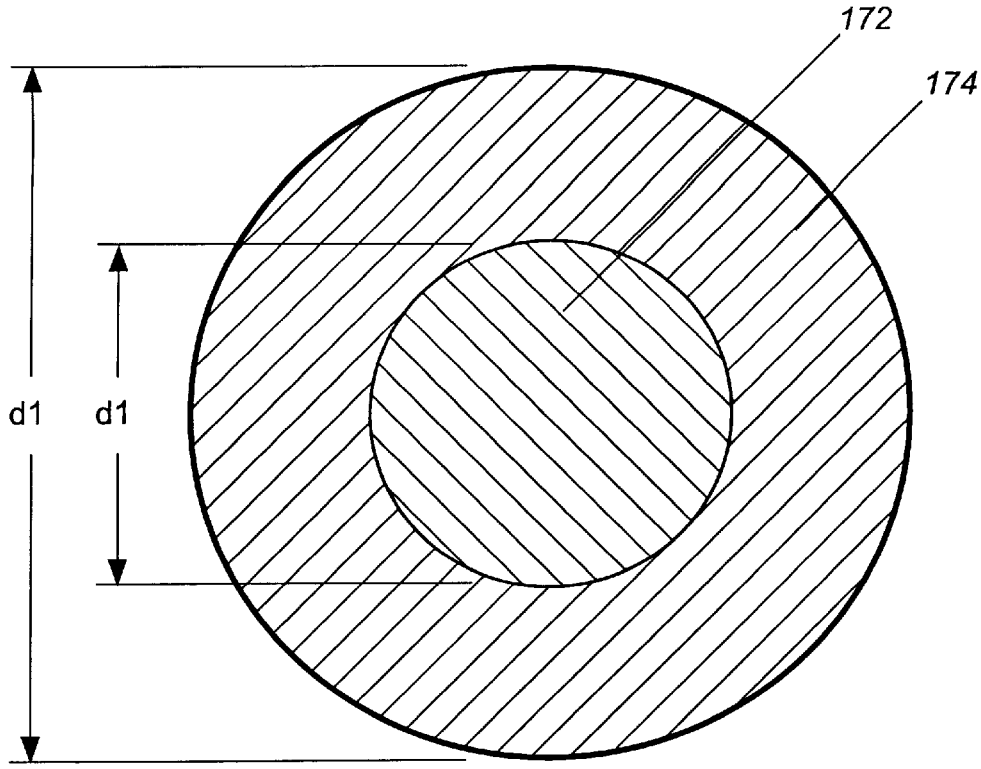
FIG. 6*a* is a top plane view of a reflector body in accordance with a seventh embodiment of the invention.
Figure 6B:
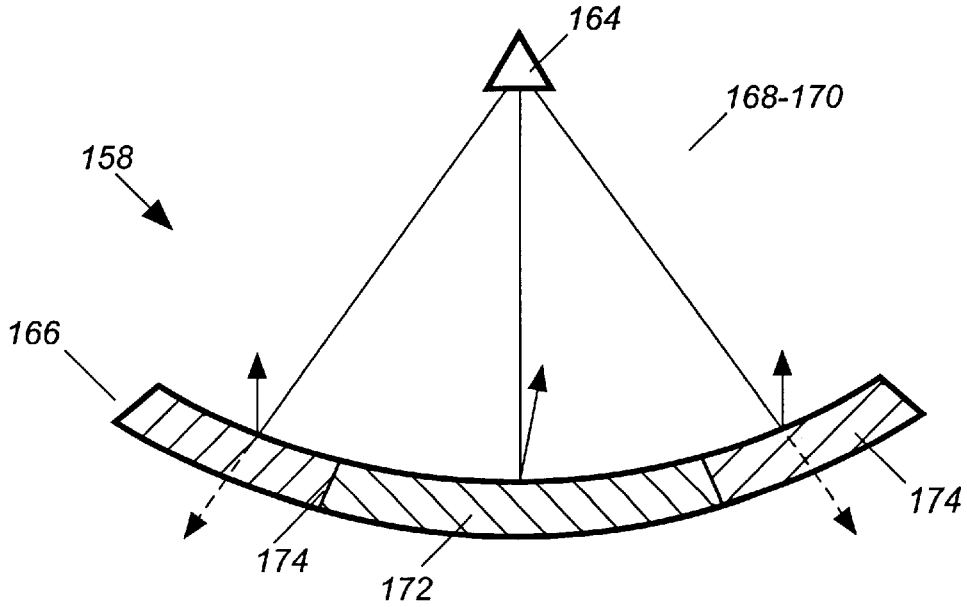
FIG. 6*b* is a side plane view of a reflector antenna having the reflector body shown in FIG. 6*a;*
Figure 6C:
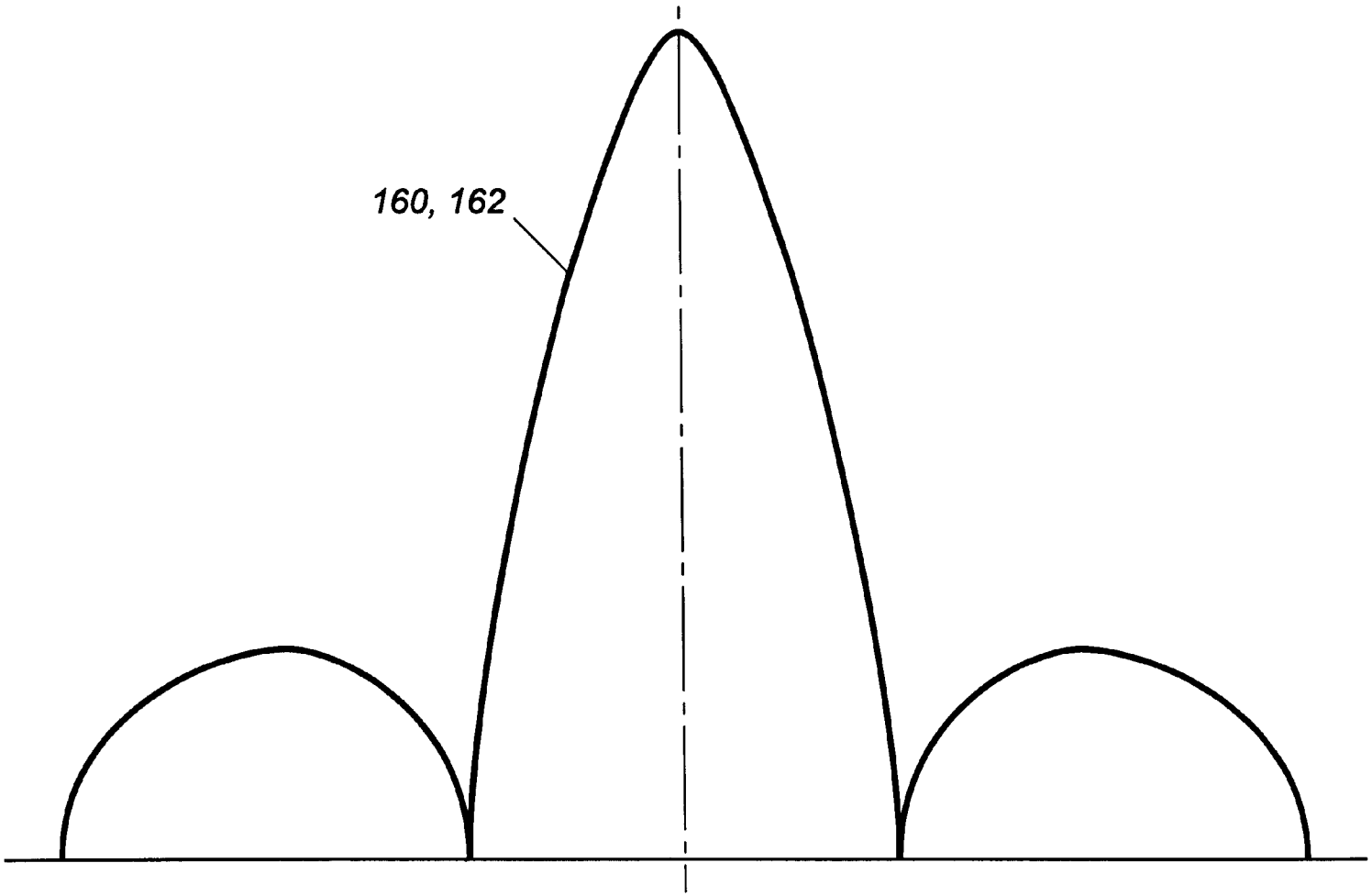
FIG. 6*c* shows antenna patterns generated by the reflector antenna shown in FIG. 6*b;*

For the embodiment of the invention shown in FIGS. 6*a*–6*c,* the reflector antenna 158 generates two antenna patterns 160 and 162 each having approximately the same shape and beamwidth with the first antenna pattern 160 being at a frequency of approximately 20 GHz and the second antenna pattern 162 being at a frequency of approximately 30 GHz. The reflector antenna 158 includes an illumination source 164 and a reflector body 166. The illumination source 164 is configured to illuminate the reflector body 166 with two RF signals, depicted by the lines marked 168 and 170. The first 168 and second 170 RF signals have frequencies of 20 & *30* GHz respectively. The first zone 172 of the reflector body 166 is configured to be reflective to RF signals having frequencies of 20 and 30 GHz and the second zone 174 is a frequency selective zone 174 which is configured to be reflective to RF signals having a frequency of 20 GHz and pass RF signals having a frequency of 30 GHz signal. The first 172 and second 174 zones of the reflector body 166 are dimensioned to generate antenna patterns 160 and 162 having equal beamwidths at frequencies of 20 and 30 GHz respectively. Since the beamwidth of an antenna pattern 160 and 162 is inversely proportional to both the frequency and the diameter d1 or d2 of the reflective zones 172 and 174, generating the antenna pattern 160 and 162 respectively, to generate antenna patterns at both 20 and 30 GHz which have the same beamwidth, the diameter d1 of the first zone 172 should be approximately two thirds the diameter d2 of the second zone 174.

Figure 7A:
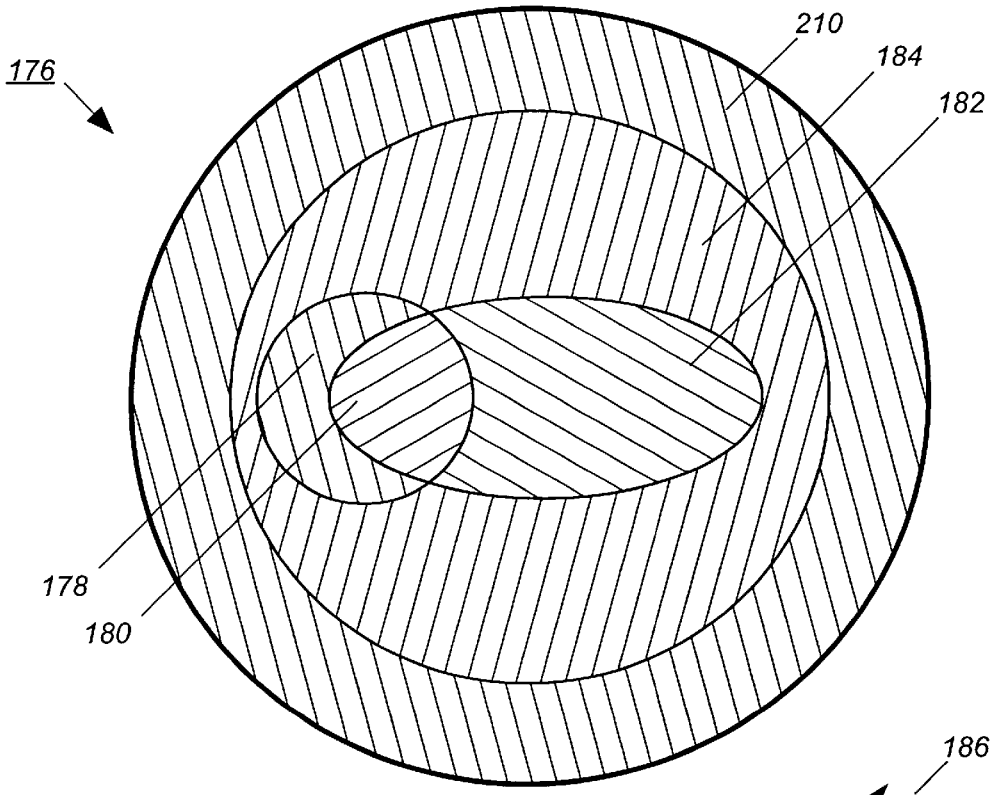
FIG. 7*a* is a side plane view of a reflector body in accordance with a eighth embodiment of the invention.
Figure 7B:
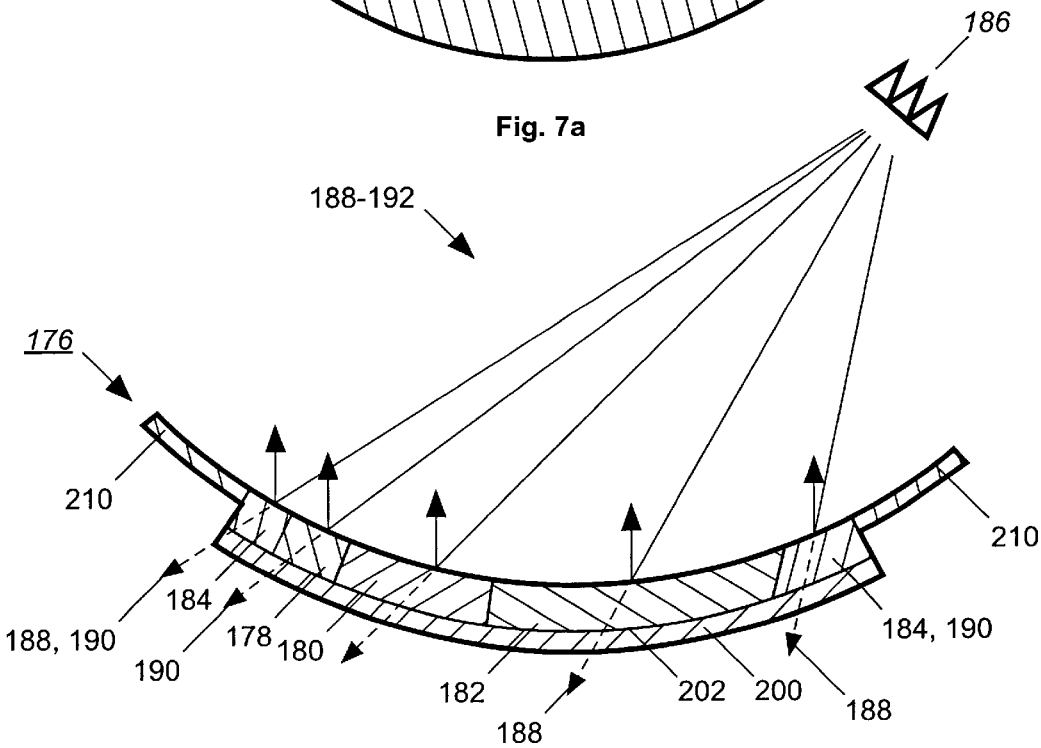
FIG. 7*b* is a side plane view of a reflector antenna having the reflector body shown in FIG. 7*a*; and, FIG. 7*c* shows antenna patterns generated by the reflector antenna shown in FIG. 7*b*.
Figure 7C:
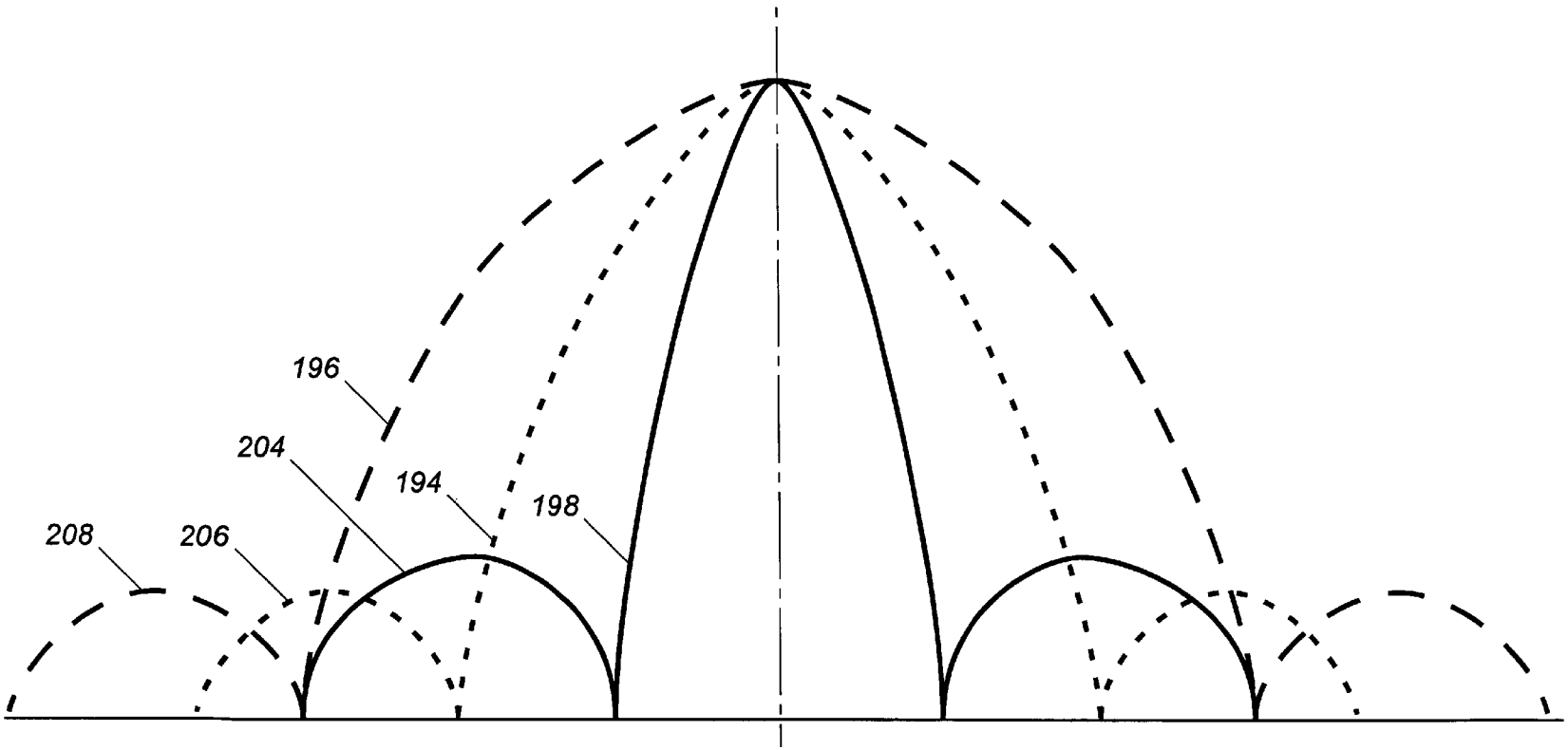

Referring to FIGS. 7*a*–7*c,* the present invention is not limited to antenna reflectors having concentric zones but may be implemented with a reflector body 176 having a plurality of zones 178–184 located within the reflector body 176, with each zone 178–184 being of a preselected shape and dimension. For this embodiment, the illumination source 186 is configured to generate three RF signals, depicted by the lines marked 188–192. The first and second zones 178 and 180 are configured to reflect the first RF signal 188 generating a first antenna pattern 194 therefrom whereas the third 182 and fourth 184 zones are configured to pass the first RF signal 188. The second 180 and third 182 zones are configured to reflect the second RF signal 190 generating a second antenna pattern 196 therefrom whereas the first 178 and fourth 184 zones are configured to pass the second RF signal 190. All four zones 178–184 are configured to reflect the third RF signal 192 and generate a third antenna pattern 198 therefrom.

The portions of the first 188 and second 190 RF signals which pass through zones 178–184 of the reflector body 176 can create problems in other electronic components (not shown) being in a close proximity to the reflector body 176. RF absorbing material 200 can be attached to the bottom side 202 of the reflector body 176 and absorb the passed through RF signals 188–190.

It is typically desirable for the antenna patterns 196–198 generated from a reflector body 176 to have low sidelobe levels 204–208. To do so, a ring of resistive material 210, such as R-card™ manufactured by Southwall Technologies Corporation located in Palo Alto, Calif. can be coupled to the reflector body 176. Analysis has shown that the sidelobe levels 204–208 of an antenna pattern 194–198 generated by a reflector body 176 is decreased when resistive material 210 is coupled to the edge of a reflector body 176.

The present invention utilizes a preselected plurality of frequency selective and/or polarization sensitive zones to provide multiple antenna patterns from a single reflector antenna. By configuring each zone to a preselected shape and dimension, the present invention generates a plurality of antenna patterns from a single reflector body with each antenna pattern having a desired shape and beamwidth. In this manner, a single reflector can replace multiple reflector antennas saving weight, cost and real estate.

It will be appreciated by persons skilled in the art that the present invention is not limited to what has been shown and described hereinabove. The scope of the invention is limited solely by the claims which follow.

What is claimed is:

1. An antenna for providing multiple antenna patterns from a plurality of RF illumination signals having differing electrical characteristics from a single reflector antenna comprising:

a concave reflector body formed of a plurality of zones, each of the zones is configured to reflect a portion of one of the RF illumination signals and a first of which is configured to be non-reflective to one of the RF illumination signals having a different electrical characteristic than the electrical characteristic of the RF illumination signal reflected by the first zone, at least one of said zones is both a frequency selective and a polarization sensitive zone;

an illumination source configured to illuminate said reflector body with the plurality of RF signals; and absorbing material coupled to said reflector body and operative to absorb a non-reflected portion of one of said RF illumination signals, each of said zones reflecting one of the RF illumination signals, each reflected RF signal generating one of the plurality of antenna patterns.

2. An antenna in accordance with claim 1, wherein said non-reflective zone is formed of a dielectric core coupled to a patterned metallic top layer configured to reflect preselected RF signals and pass other preselected RF signals.

3. An antenna in accordance with claim 1, wherein said absorbing material is coupled to a bottom side of said first zone and is configured to absorb said one non-reflected RF signal having a different electrical characteristic than the electrical characteristic of the RF illumination signal reflected by the first zone.

4. An antenna in accordance with claim 1, wherein each said zone has a predetermined shape and said antenna patterns are generated by one or more zones.

5. An antenna in accordance with claim 1,wherein said plurality of RF signals comprise a first RF signal having a frequency of 20 GHz and a second RF signal having a frequency of 30 GHz, said plurality of zones comprising a first zone configured to reflect signals having frequencies of 20 and 30 GHz and a second zone being of a frequency selective material configured to reflect RF signals having frequencies of 20 GHz and pass RF signals having frequencies of 30 GHz, said second RF signal being reflected from said first zone and passing through said second zone, said first RF signal being reflected by both said first and said second zones, first and second antenna patterns being generated from said first and second reflected RF signals, said first and second zones being concentric and dimensioned such that said first and second antenna patterns have approximately similar shapes and beamwidths.

6. An antenna for providing multiple antenna patterns from a plurality of RF illumination signals having a plurality frequency and polarization characteristics from a single reflector antenna comprising:

an illumination source configured to illuminate said reflector body with the plurality of RF signals;

a concave reflector body formed of a plurality of zones, each of which is configured to reflect a portion of one of the RF illumination signals, a first of which is configured to be non-reflective to one of the RF illumination signals having a different polarization characteristic than the RF illumination signal reflected by the first zone, a second of which is configured to be non-reflective to one of the RF illumination signals having a different frequency characteristic than the RF illumination signal reflected by the second zone, each reflected RF signal generating one of the plurality of antenna patterns.

7. An antenna in accordance with claim 6, wherein said illumination source is a single feed horn.

8. An antenna in accordance with claim 6, wherein said first zone is a first frequency selective zone configured to pass RF signals of a first frequency and reflect RF signals of a second frequency, one of said RF signals being at said second frequency and one of said RF signals being at said first frequency.

9. An antenna in accordance with claim 8, wherein said second zone is a polarization sensitive zone configured to reflect RF signals having a first sense of polarization and pass RF signals having a second sense of polarization, one of said RF signals having said first sense of polarization, another one of said RF signals having said second sense of polarization.

10. An antenna in accordance with claim 9, wherein said first sense of polarization is approximately orthogonal to said second sense of polarization.

11. An antenna in accordance with claim 6, where said first zone is encompassed by said second zone.

12. An antenna in accordance with claim 6, wherein said plurality of zones are configured concentrically creating an innermost zone and a plurality of successive zones, each said successive zone encompassing a previous zone, said innermost zone being configured to reflect all said RF signals and each successive zone being configured to reflect less RF signals than said innermost zone.

13. An antenna in accordance with claim 12, wherein said innermost zone generates a first antenna pattern and each successive zone together with previous zones generate additional antenna patterns.

14. An antenna in accordance with claim 6, wherein each of said antenna patterns has antenna pattern characteristics comprising beamwidth and shape, each zone being configured to preselected dimensions such that said plurality of antenna patterns are generated having preselected shapes and beamwidths.

15. An antenna in accordance with claim 14, wherein each said zone is configured to preselected dimensions such that said plurality of antenna patterns have approximately equivalent shapes and beamwidths.

* * * * *